US008922613B2

(12) United States Patent
Akagi

(10) Patent No.: US 8,922,613 B2
(45) Date of Patent: Dec. 30, 2014

(54) LIGHT BEAM SCANNING DEVICE THAT PERFORMS HIGH-ACCURACY LIGHT AMOUNT CONTROL, METHOD OF CONTROLLING THE DEVICE, STORAGE MEDIUM, AND IMAGE FORMING APPARATUS

(71) Applicant: Canon Kabushiki Kaisha, Tokyo (JP)

(72) Inventor: Daisuke Akagi, Abiko (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 13/871,359

(22) Filed: Apr. 26, 2013

(65) Prior Publication Data

US 2013/0287418 A1 Oct. 31, 2013

(30) Foreign Application Priority Data

Apr. 26, 2012 (JP) ..... 2012-101250

(51) Int. Cl.
*B41J 2/435* (2006.01)
*B41J 2/385* (2006.01)
*G03G 15/043* (2006.01)

(52) U.S. Cl.
CPC ..... *G03G 15/043* (2013.01); *G03G 2215/0129* (2013.01)
USPC ..... 347/236; 347/246; 347/237; 347/247; 347/133

(58) Field of Classification Search
USPC ..... 347/236, 237, 246, 247, 133
See application file for complete search history.

(56) References Cited

U.S. PATENT DOCUMENTS

| | | | | |
|---|---|---|---|---|
| 5,687,002 | A * | 11/1997 | Itoh | 347/133 |
| 7,944,459 | B2 * | 5/2011 | Miyazawa | 345/691 |
| 2010/0150591 | A1 * | 6/2010 | Yamashita | 399/51 |
| 2012/0008486 | A1 * | 1/2012 | Terada | 369/116 |
| 2013/0027383 | A1 * | 1/2013 | Odawara et al. | 345/212 |
| 2013/0207950 | A1 * | 8/2013 | Haruna et al. | 345/207 |

FOREIGN PATENT DOCUMENTS

| | | | |
|---|---|---|---|
| JP | 05-145154 | A | 6/1993 |
| JP | 2002-100831 | A | 4/2002 |

* cited by examiner

*Primary Examiner* — Sarah Al Hashimi
(74) *Attorney, Agent, or Firm* — Rossi, Kimms & McDowell LLP

(57) ABSTRACT

A light beam scanning device which is capable of performing high-accuracy light amount control without complicated control even when the device includes a laser diode having non-linear I-L characteristics. Gain circuits set the amount of light to be emitted from the laser diode. A PD circuit board detects the amount of the emitted light. A laser controller controls the amount of the emitted light by adjusting drive current applied to the laser diode based on a detection output from the PD circuit board. A CPU corrects data for correcting the drive current. The CPU decides a light amount correction range for correcting the light amount based on the correction data, calculates the slope of the I-L characteristics in the light amount correction range based on light amounts at two points within the light amount correction range and drive currents associated with the respective light amounts, and corrects the correction data using the calculated slope.

9 Claims, 15 Drawing Sheets

LIGHT BEAM SCANNING DEVICE THAT PERFORMS HIGH-ACCURACY LIGHT AMOUNT CONTROL, METHOD OF CONTROLLING THE DEVICE, STORAGE MEDIUM, AND IMAGE FORMING APPARATUS

BACKGROUND OF THE INVENTION

1. Field of the Invention

The present invention relates to a light beam scanning device having nonlinear drive current-light amount characteristics (I-L characteristics), a method of controlling the same, a storage medium, and an image forming apparatus including the light beam scanning device.

2. Description of the Related Art

It is known that in a general semiconductor laser diode used in an image forming apparatus and the like, the slope of light emission characteristics representative of a correspondence relationship between drive current and light amount (hereinafter referred to as the "I-L characteristics") is non-linear, as shown in FIG. 17. Further, in such a laser diode, there has been proposed the following control technique for controlling a target light amount: A threshold current Ith of the laser diode and a slope $\eta$ of the I-L characteristics are calculated based on light amounts (P1 and P2) at two points and drive currents (I1 and I2) associated therewith, and based on the results of the calculations, a drive current (I3) associated with a desired light amount (P3) is calculated and set (see e.g. Japanese Patent Laid-Open Publication No. H05-145154).

By the way, assuming that the I-L characteristics are nonlinear as in the case of a surface emitting laser diode (VCSEL), as the difference between the light amounts (P1 and P2) at two points from which the slope of the I-L characteristics is calculated is larger, an error between the calculated slope and an actual slope becomes larger, as shown in FIG. 18. This produces a difference between the light amount (P3) as a target light amount and a light amount (P3') actually controlled, so that the accuracy of the light amount control is degraded.

On the other hand, a technique has been proposed in which the light amount is controlled by storing the relationship between temperature and I-L characteristics in a memory, monitoring temperature to read out I-L characteristics associated therewith, and setting a drive current based on the read I-L characteristics (see e.g. Japanese Patent Laid-Open Publication No. 2002-100831). Further, a method as well has been proposed in Japanese Patent Laid-Open Publication No. 2002-100831, in which I-L characteristics stored in the memory are corrected by emitting light from a laser diode using a predetermined drive current, irradiating a photosensitive drum with the light, and measuring the surface potential of the photosensitive drum.

However, in general, the I-L characteristics of the laser diode are changed not only by temperature but also by aging, as shown in FIG. 19. Therefore, the method of storing I-L characteristics in a manner associated with temperature and performing the light amount control based on the stored I-L characteristics suffers from a problem that a change in the I-L characteristics caused by aging cannot be followed up, whereby the accuracy of the light amount control is lowered as aging advances.

Further, in the case of the method in which the photosensitive drum is irradiated using a plurality of light amounts, and the I-L characteristics of the laser diode are predicted and corrected based on the surface potentials of the photosensitive drum, it is difficult to know the characteristics of the laser diode alone because the control becomes complicated the photosensitive drum has a characteristic that the relationship between the amount of change in the surface potential and the amount of exposure is not linear, and so forth. This brings about the problem that when the optical correction of the light beam scanning device is performed, there occurs a large correction error.

SUMMARY OF THE INVENTION

The present invention provides a light beam scanning device which is capable of performing high-accuracy light amount control without making the control complicated even when the light beam scanning device uses a laser diode having non-linear light emission characteristics.

In a first aspect of the present invention, there is provided light beam scanning device comprising a laser diode configured to emit an amount of light based on a value of drive current supplied thereto, a light amount-setting unit configured to set the amount of light to be emitted from the laser diode, a light amount detection unit configured to detect the amount of light emitted from the laser diode, a light amount control unit configured to control the amount of light to be emitted from the laser diode by adjusting the value of drive current supplied to the laser diode based on a detection output from the light amount detection unit, and a data correction unit configured to correct correction data for correcting the value of the drive current, wherein the data correction unit decides a light amount correction range in which the amount of light to be emitted amount is corrected based on a value of the correction data, calculates a slope of light emission characteristics representative of a correspondence relationship between the value of drive current and the amount of light to be emitted of the laser diode within the light amount correction range based on light amounts at two points within the light amount correction range and values of drive current associated with the light amounts at the two points, and corrects the correction data using the calculated slope.

In a second aspect of the present invention, there is provided an image forming apparatus including a light beam scanning device, wherein the light beam scanning device comprises a laser diode configured to emit an amount of light based on a value of drive current supplied thereto, a light amount-setting unit configured to set the amount of light to be emitted from the laser diode, a light amount detection unit configured to detect the amount of light emitted from the laser diode, a light amount control unit configured to control the amount of light to be emitted from the laser diode by adjusting the value of drive current supplied to the laser diode based on a detection output from the light amount detection unit, and a data correction unit configured to correct correction data for correcting the value of the drive current, wherein the data correction unit decides a light amount correction range in which the amount of light to be emitted amount is corrected based on a value of the correction data, calculates a slope of light emission characteristics representative of a correspondence relationship between the value of drive current and the amount of light to be emitted of the laser diode within the light amount correction range based on light amounts at two points within the light amount correction range and values of drive current associated with the light amounts at the two points, and corrects the correction data using the calculated slope.

In a third aspect of the present invention, there is provided a method of controlling a light beam scanning device, comprising setting an amount of light to be emitted from a laser diode having non-linear light emission characteristics, detecting an amount of light emitted from the laser diode, controlling the amount of light to be emitted from the laser diode by adjusting a value of drive current to be supplied to the laser diode based on the detected amount of light, and correcting correction data for correcting the value of the drive current, wherein the correcting of the correction data includes deciding a light amount correction range in which the amount of light to be emitted amount is corrected based on a value of the correction data, calculating a slope of light emission characteristics representative of a correspondence relationship between the value of drive current and the amount of light to be emitted of the laser diode within the light amount correction range, based on light amounts at two points within the light amount correction range and values of drive current associated with the light amounts at the two points, and correcting the correction data using the calculated slope.

In a fourth aspect of the present invention, there is provided a non-transitory computer-readable storage medium storing a computer-executable control program for executing a method of controlling a light beam scanning device, wherein the method comprises setting an amount of light to be emitted from a laser diode having non-linear light emission characteristics, detecting an amount of light emitted from the laser diode, controlling the amount of light to be emitted from the laser diode by adjusting a value of drive current to be supplied to the laser diode based on the detected amount of light, and correcting correction data for correcting the value of the drive current, wherein the correcting of the correction data includes deciding a light amount correction range in which the amount of light to be emitted amount is corrected based on a value of the correction data, calculating a slope of light emission characteristics representative of a correspondence relationship between the value of drive current and the amount of light to be emitted of the laser diode within the light amount correction range, based on light amounts at two points within the light amount correction range and values of drive current associated with the light amounts at the two points, and correcting the correction data using the calculated slope.

According to the present invention, it is possible to perform high-accuracy light amount control without complicated control even when laser diodes having non-linear light emission characteristics are used.

Further features of the present invention will become apparent from the following description of exemplary embodiments with reference to the attached drawings.

DESCRIPTION OF THE EMBODIMENTS

The present invention will now be described in detail below with reference to the accompanying drawings showing embodiments thereof.

Figure 1:
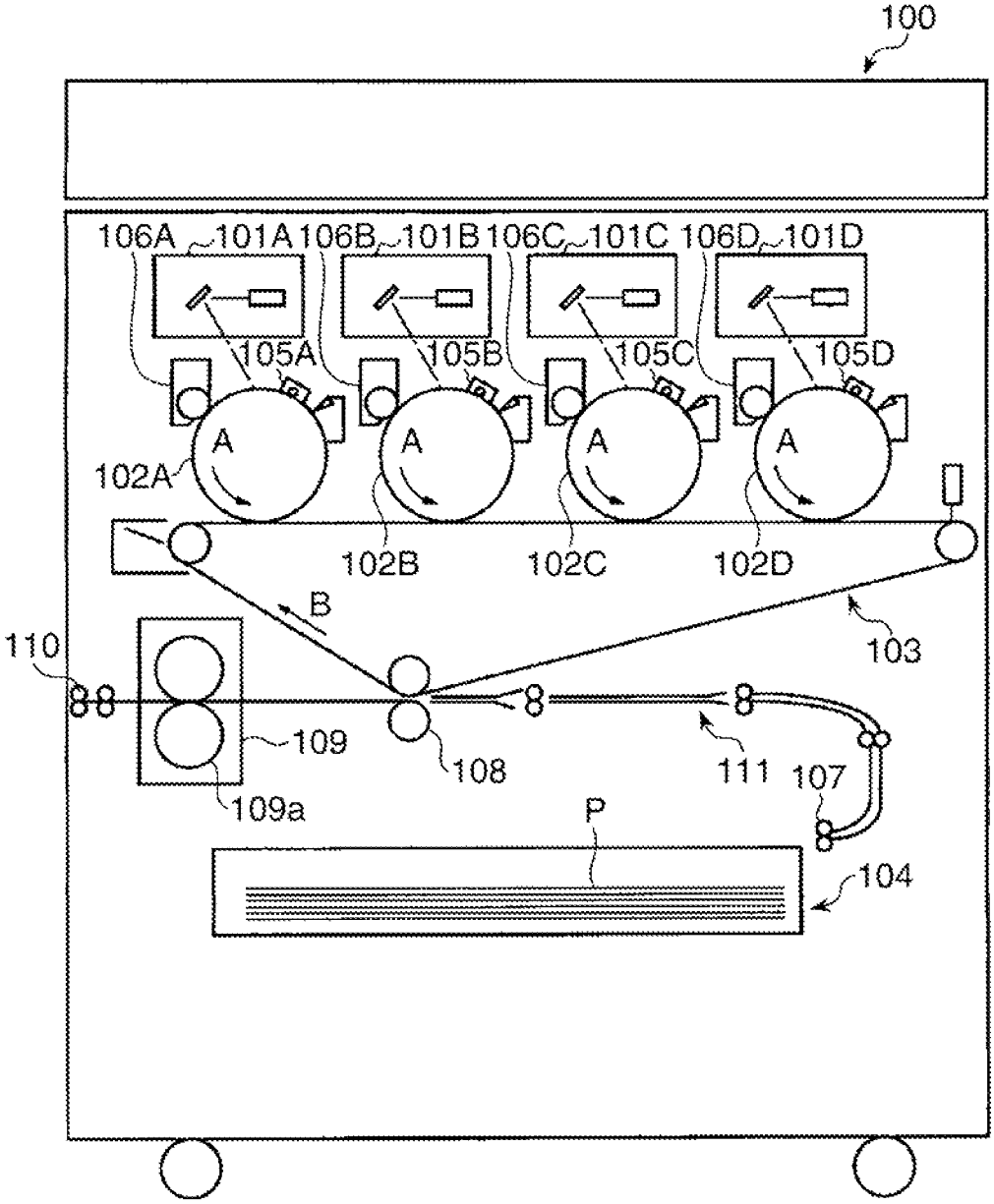
FIG. 1 is a cross-sectional view showing the overall arrangement of an image forming apparatus according to an embodiment of the present invention.

FIG. 1 is a cross-sectional view of the overall arrangement of an image forming apparatus according to an embodiment of the present invention. The image forming apparatus comprises a plurality of image forming units each equipped with a light beam scanning device (hereinafter referred to as the "laser scanner").

Referring to FIG. 1, an electrophotographic color copying machine 100 as the image forming apparatus mainly comprises the image forming units, an intermediate transfer unit 103, a conveying unit 111, and a sheet feeder unit 104, which are sequentially arranged below the image forming apparatus, as viewed in FIG. 1. The plurality of e.g. four image forming units include photosensitive drums 102A to 102D as photosensitive members, primary electrostatic chargers 105A to 105D, developing devices 106A to 106D, and the laser scanners 101A to 101D, respectively. The primary electrostatic chargers 105A to 105D uniformly charge the surfaces of the respective photosensitive drums 102A to 102D. The laser scanners 101A to 101D irradiate laser beams onto the surfaces of the respective photosensitive drums 102A to 102D, uniformly charged by the primary electrostatic chargers 105A to 105D, to thereby form electrostatic latent images on the surfaces. The developing devices 106A to 106D supply toner to the electrostatic latent images formed on the surfaces of the photosensitive drums 102A to 102D to thereby visualize the electrostatic latent images.

The intermediate transfer unit 103 includes a secondary transfer belt which is endless and supported by a plurality of rollers including one roller of a secondary transfer roller pair 108. Further, the conveying unit 111 comprises a pickup roller 107 for picking up transfer materials (sheets) P from the sheet feeder unit 104 one by one, the other roller of the secondary transfer roller pair 108, a fixing device 109, and a sheet discharge section 110. The fixing device 109 includes a fixing roller 109*a*. Images formed by visualizing the electrostatic latent images on the photosensitive drums 102A to 102D are transferred onto the secondary transfer belt of the intermediate transfer unit 103 to form a color image thereon. The color image is transferred onto the transfer material P and is fixed thereto by the fixing device 109.

In the image forming apparatus 100 configured as above, the primary electrostatic chargers 105A to 105D uniformly charge the surfaces of the respective photosensitive drums 102A to 102D each rotating in a direction indicated by an arrow A. The respective laser scanners 101A to 101D scan the surfaces of the uniformly charged photosensitive drums 102A to 102D with laser beams modulated based on image data, to thereby form electrostatic latent images on the surfaces of the photosensitive drums 102A to 102D, respectively. The scanning direction of each laser beam is a main scanning direction, and a direction orthogonal to the main scanning direction is a sub scanning direction.

Then, the developing devices 106A to 106D supply the photosensitive drums 102A to 102D with toners of respective colors associated therewith to thereby visualize the respective electrostatic latent images formed on the surfaces of the photosensitive drums 102A to 102D. The visualized images on the photosensitive drums 102A to 102D are sequentially primarily transferred onto the secondary transfer belt of the intermediate transfer unit 103 rotating along a direction indicated by an arrow B, as viewed in FIG. 1, to form a color image. At this time, the transfer materials P are picked up from the sheet feeder unit 104 one by one by the pickup roller 107, and each picked-up transfer material P is conveyed to the secondary transfer roller 108, by which the color image transferred onto the intermediate transfer unit 103 is transferred onto the transfer material P. The color image transferred onto the transfer material P is fixed thereto by the fixing device 109 including the fixing roller 109*a* equipped with a heat source, such as a halogen heater. The transfer material P having the color image fixed thereto is discharged out of the system via the sheet discharge section 110.

Next, the laser scanner provided in the image forming apparatus 100 will be described in detail with reference to FIG. 2.

Figure 2:
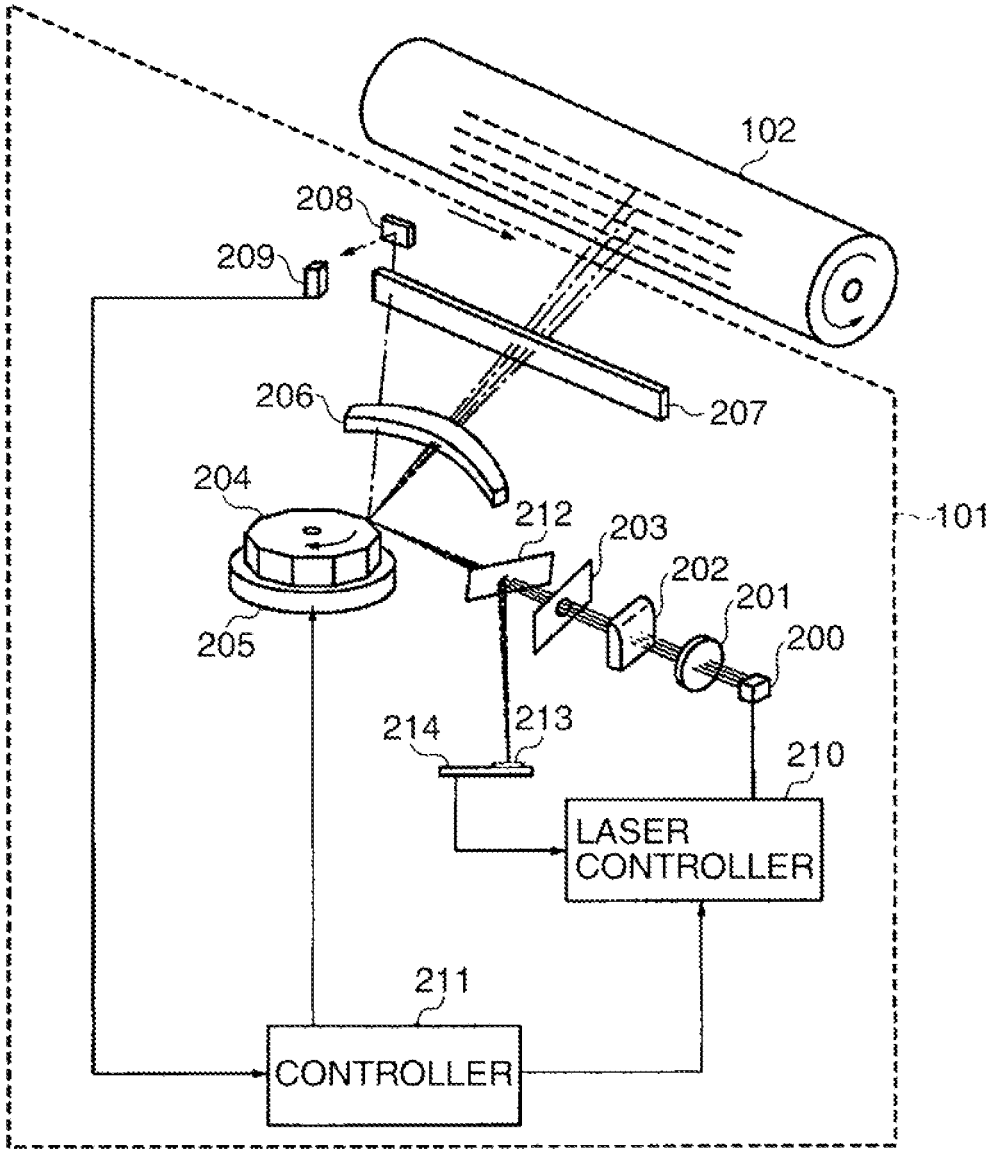
FIG. 2 is a view showing the overall arrangement of a laser scanner provided in the FIG. 1 image forming apparatus.

FIG. 2 is a view showing the overall arrangement of the laser scanner provided in the image forming apparatus shown in FIG. 1.

Referring to FIG. 2, the laser scanner 101 comprises a PD (photodiode) circuit board 214 including a laser diode 200 as a light source, a collimator lens 201, a cylindrical lens 202, an aperture diaphragm 203, a half mirror 212 and a photodiode (PD sensor) 213. The laser scanner 101 further comprises a polygon mirror 204, a polygon motor 205, an fθ lens 206, a condensing lens 207, a reflection mirror 208, a synchronization sensor 209, a laser controller 210, and a controller 211.

The laser controller 210 controls the light emission of the laser diode 200 according to a control signal from the controller 211. A laser beam emitted from the laser diode 200 is collimated through the collimator lens 201 to form a collimated laser beam. The cylindrical lens 202 has a refractive index only in the sub scanning direction, and condenses the laser beam, which has been collimated through the collimator lens 201, in the sub scanning direction. Then, the aperture diaphragm 203 reduces the diameter of the laser beam to a predetermined diameter in the main scanning direction, and the half mirror 212 reflects part of the laser beam onto the PD sensor 213 of the PD circuit board 214 and allows part of the laser beam to be irradiated onto the polygon mirror 204. The PD sensor 213 outputs a current according to the amount of light entering the same, and the PD circuit board 214 (light amount detection unit) converts the output current to a voltage, and transmits the voltage obtained by the conversion to the laser controller 210. Upon receipt of the voltage dependent on the amount of light entering the PD sensor 213, the laser controller 210 (light amount control unit) controls the amount of light emitted from the laser diode 200. Note that this light amount control will be described in detail hereinafter.

The polygon mirror 204 is rotated by the polygon motor 205 that rotates according to a control signal from the controller 211, and deflects the beam irradiated thereon. The laser beam deflected by the polygon mirror 204 passes through the fθ lens 206, and through the condensing lens 207. Then, the beam scans on the photosensitive drum 102. Here, the fθ lens 206 causes the laser beam rotated and scanned at a constant angular velocity to be scanned on the photosensitive drum 102 at a constant speed, and the condensing lens 207 condenses the laser beam to form a predetermined beam spot moving on the photosensitive drum 102. Note that the laser scanner 101 includes a reflection mirror, not shown, on a light path of the laser beam reflected by the polygon mirror 204.

Further, part of the laser beam scanned by the polygon mirror 204 is reflected from the reflection mirror 208 in predetermined timing, and enters the synchronization sensor (BD sensor) 209. The synchronization sensor 209 outputs a BD (beam detection) signal to the controller 211 upon incidence of the laser beam thereon. The BD signal synchronizes between the rotation of the polygon mirror 204 and image drawing start timing. The controller 211 monitors the BD signal to thereby control the polygon motor 205 such that the period of rotation of the polygon mirror 204 becomes always constant.

Next, the control system of the laser scanner 101 will be described in detail with reference to FIG. 3.

Figure 3:
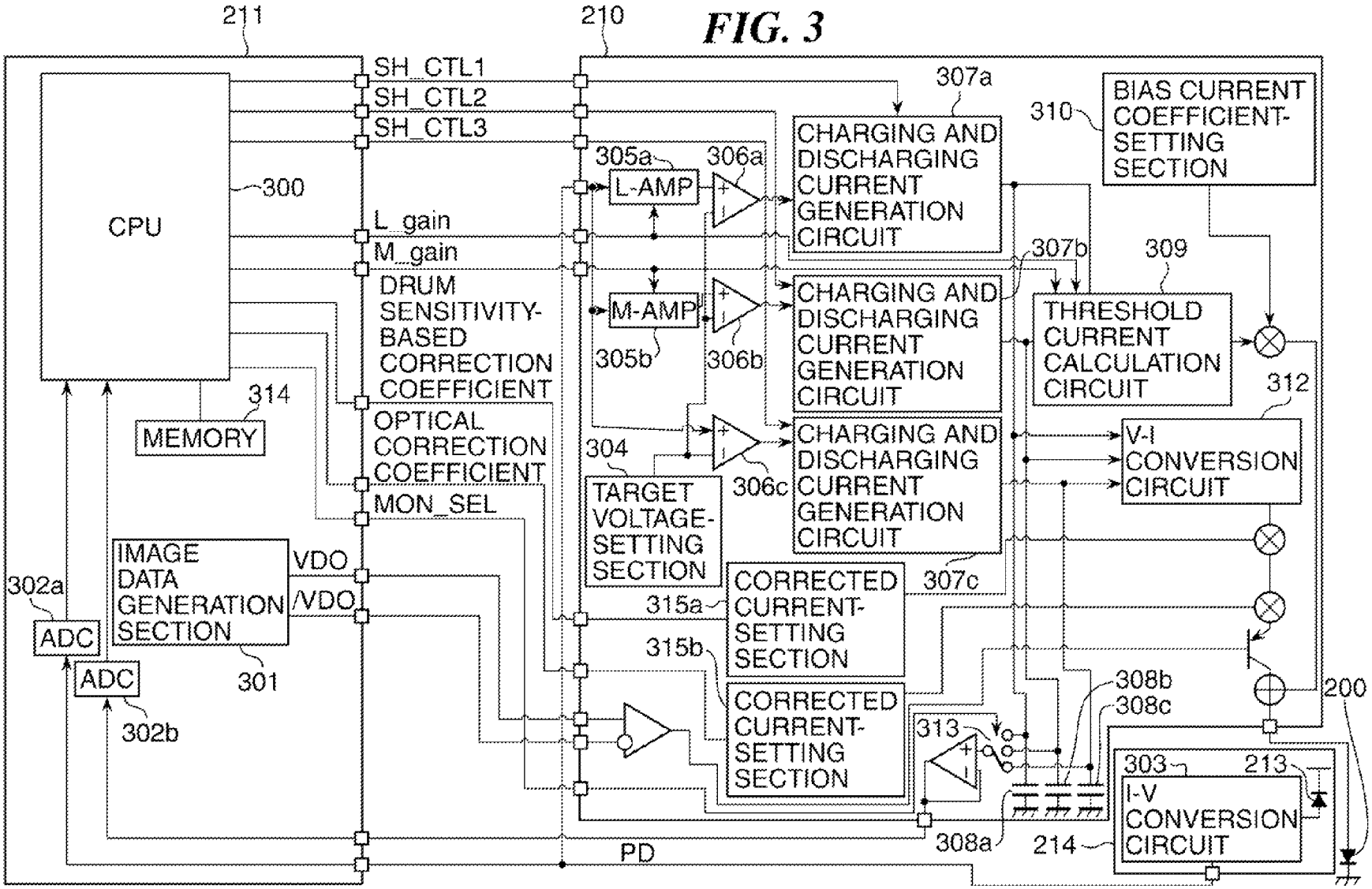
FIG. 3 is a block diagram of a control system of the FIG. 2 laser scanner.

FIG. 3 is a block diagram of the control system of the FIG. 2 laser scanner.

As shown in FIG. 3, the laser controller 210 is connected to the controller 211, the PD circuit board 214, and the laser diode 200, respectively.

The laser controller 210 comprises a target voltage-setting section 304, gain circuits (L-AMP and M-AMP) 305*a* and 305*b*, comparators 306*a*, 306*b*, and 306*c*, charging and discharging current generation circuits 307*a*, 307*b*, and 307*c*, and charge capacitors 308*a*, 308*b*, and 308*c*. The target voltage-setting section 304 sets a target voltage Vref which is used as a target value of APC (automatic power control) of the laser beams, described in detail hereinafter. The gain circuits 305*a* and 305*b* (light amount-setting units) amplify a voltage from the PD circuit board 214. Further, the comparators 306*a*, 306*b*, and 306*c* compare voltages (detection outputs) from the PD circuit board 214 with the target voltage Vref. Upon receipt of an associated SH_CTL signal from a CPU 300, each of the charging and discharging current generation circuits 307*a*, 307*b*, and 307*c* increases or decreases the current according to the result of the comparison. The charge capacitors 308*a*, 308*b*, and 308*c* are each charged with the associated current which has been increased or decreased according to the result of the comparison.

Further, the laser controller 210 comprises a V-I conversion circuit 312, a threshold current calculation circuit (threshold current calculation unit) 309, a bias current coefficient-setting section 310, a switch 313, and corrected current-setting sections (current correction units) 315*a* and 315*b*. The V-I conversion circuit 312 converts voltages charged in the charge capacitors 308*a*, 308*b*, and 308*c* to respective currents. The threshold current calculation circuit 309 calculates a threshold current of the laser diode 200 based on the voltages charged in the charge capacitors 308*a* and 308*b*. The bias current coefficient-setting section 310 decides a bias current by multiplying the threshold current by a coefficient. The switch 313 monitors the voltages of the charge capacitors 308*a*, 308*b*, and 308*c*. The corrected current-setting sections 315*a* and 315*b* have respective drive current correction coefficients set therein for correcting the current for driving the laser diode 200.

The controller 211 performs transmission of control signals and image data, arithmetic computations, and so forth. The controller 211 includes the CPU (data correction unit) 300, an image data generation section 301 for generating image data, and a memory 314 that stores current correction data (drive current correction coefficients as optical correction coefficients, referred to hereinafter) for use in correcting the current for driving the laser diode 200 according to optical characteristics of the laser scanner 101. Further, the controller 211 includes analog-to-digital converters 302*a* and 302*b* (each denoted as ADC in FIG. 3). The analog-to-digital converters 302*a* and 302*b* convert analog signals transmitted from the laser controller 210 and the PD circuit board 214 to respective digital signals.

Figure 4:
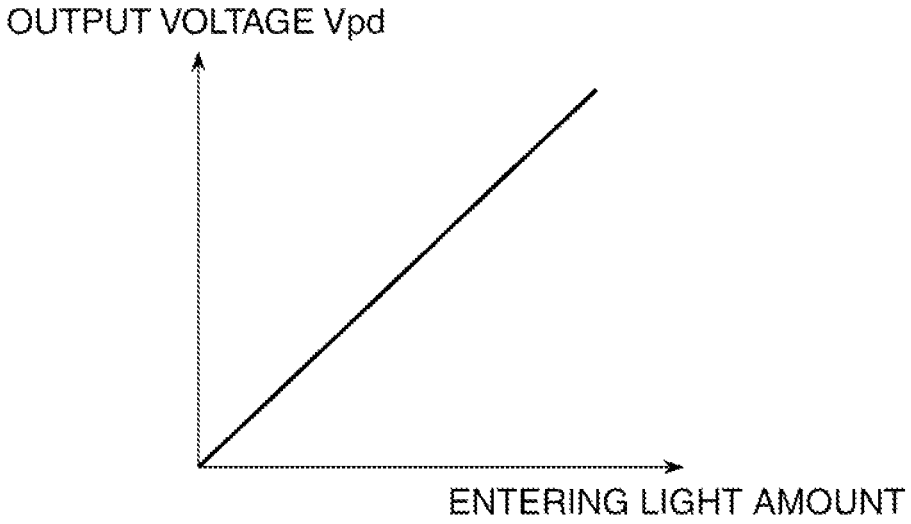
FIG. 4 is a view of input and output characteristics of a PD circuit board appearing in FIG. 3.

The PD circuit board 214 includes the PD sensor 213 for outputting current according to the amount of light emitted from the laser diode 200, and an I-V conversion circuit 303 for converting the output current from the PD sensor 213 to a voltage. FIG. 4 is a view of input and output characteristics of the PD circuit board 214 appearing in FIG. 3. As shown in FIG. 4, the PD circuit board 214 outputs a voltage Vpd proportional to the amount of light entering the same.

Hereinafter, a description will be given of a light amount control process as a method of controlling the laser scanner (a method of controlling the light beam scanning device) configured as above. The present process is executed by the CPU 300 of the controller 211 according to a light amount control recipe implemented by a light amount control program.

Figure 5A:
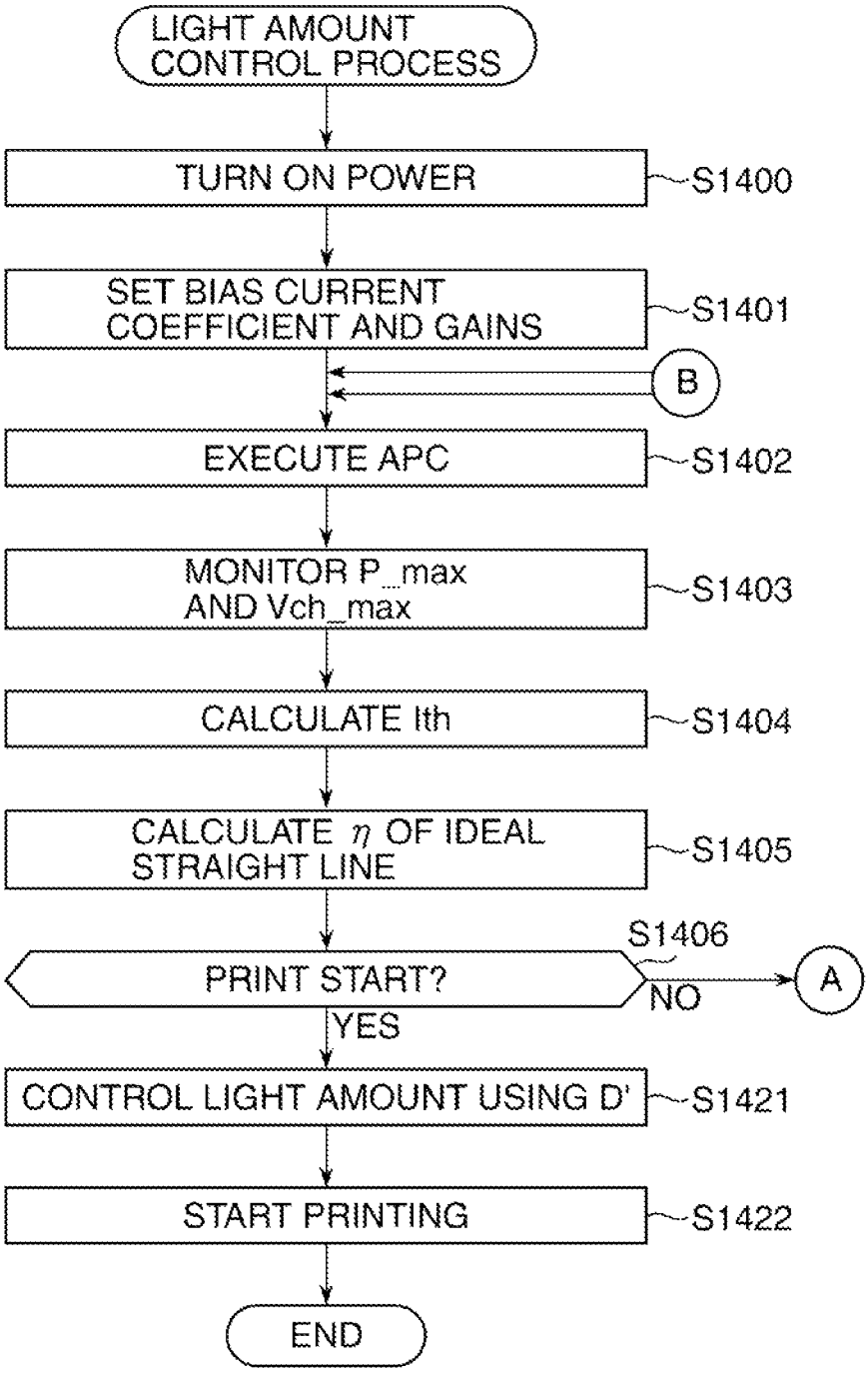
FIG. 5A is a flowchart of a light amount control process executed by a CPU appearing in FIG. 3 for controlling the amount of light to be emitted from the laser scanner.
Figure 5B:
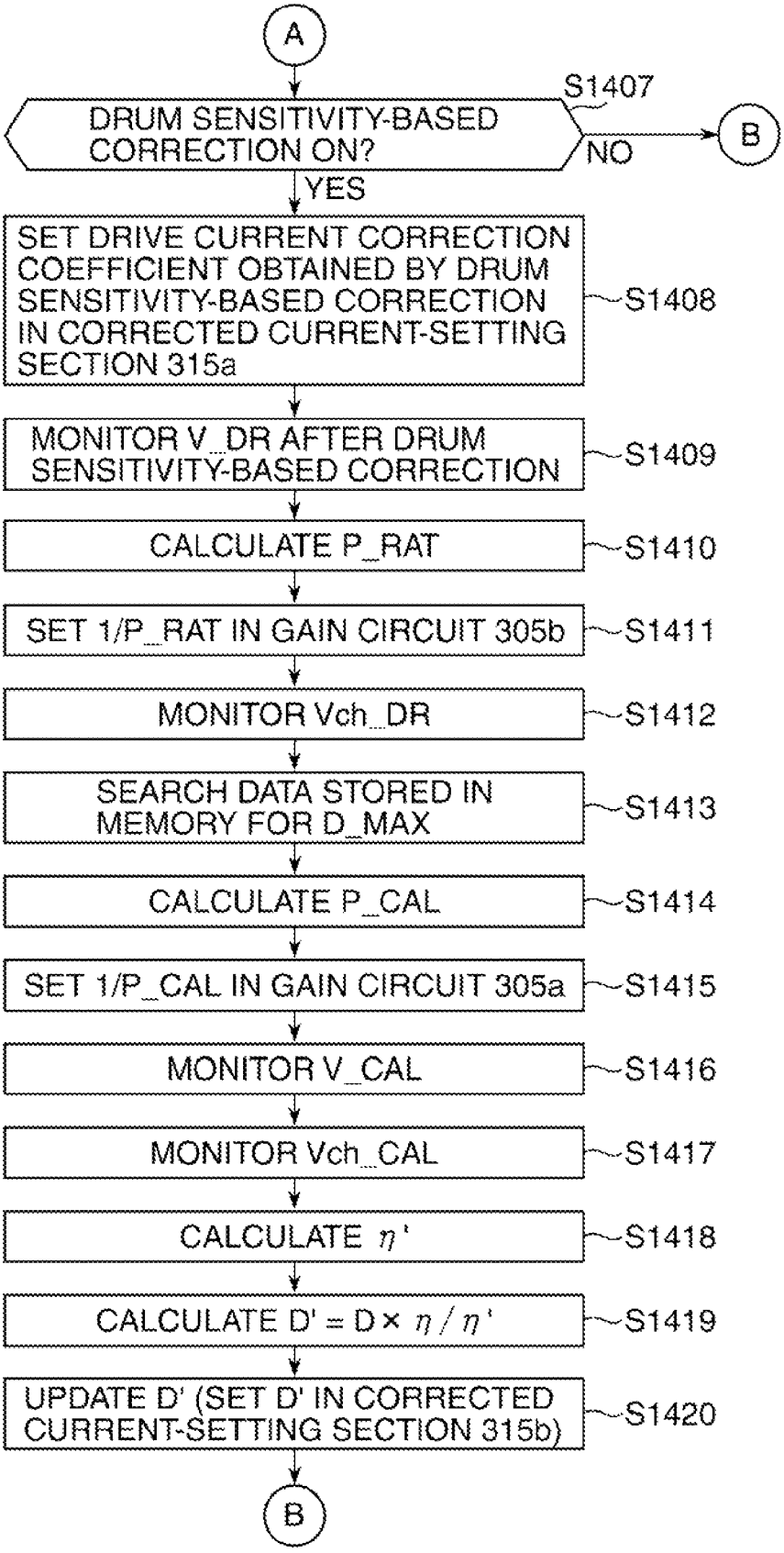
FIG. 5B is a continuation of FIG. 5A.

FIGS. 5A and 5B are flowcharts of the light amount control process executed by the CPU 300 appearing in FIG. 3 for controlling the amount of light to be emitted from the laser scanner.

When the light amount control process by the laser scanner 101 is started, first, the power of the image forming apparatus 100 is turned on (step S1400). Upon turning-on of the power of the image forming apparatus 100, the CPU 300 sets a bias current coefficient and gains in the bias current coefficient-setting section 310 and the gain circuits 305*a* and 305*b* of the laser controller 210, respectively (step S1401).

Next, the CPU 300 performs APC to thereby control the amount of light emitted from the laser diode 200 to a target light amount (step S1402). APC is control for making constant the amount of light emitted from the laser diode 200, and in the present embodiment, APC controls the amount of light emitted from the laser diode 200 to a maximum light amount P_max used in the image forming apparatus 100.

Hereinafter, APC will be described in detail.

When the CPU 300 controls the laser controller 210 to thereby cause the laser diode 200 to emit light, and the PD sensor 213 of the PD circuit board 214 receives the light emitted from the laser diode 200, the PD circuit board 214 outputs the voltage Vpd to the laser controller 210 according to the amount of light emitted from the laser diode 200. When the voltage Vpd is input to the laser controller 210 according to the amount of the emitted light, the comparator 306*c* compares the input voltage Vpd and the target voltage Vref set in advance in the target voltage-setting section 304.

In a case where the relationship between the two is expressed by the following expression (1):

$$Vpd < Vref \quad (1)$$

the comparator 306*c* determines that the amount of the light emitted from the laser diode 200 is lower than the target light amount. Then, the charging and discharging current generation circuit 307*c* charges the charge capacitor 308*c* to increase a charge voltage thereof.

On the other hand, in a case where the relationship therebetween is expressed by the following expression (2):

$$Vpd > Vref \quad (2)$$

the comparator 306*c* determines that the amount of the light emitted from the laser diode 200 is larger than the target light amount. Then, the charging and discharging current generation circuit 307*c* discharges electric charges accumulated in the charge capacitor 308*c* to reduce the charge voltage of the charge capacitor 308*c*. Note that the above-described charging and discharging operations are performed while an SH_CTL3 signal is being input from the CPU 300 to the charging and discharging current generation circuit 307*c*, and during the other times, the electric charge of the charge capacitor 308*c* is held.

Then, the V-I conversion circuit 312 adjusts current according to the voltage of the charge capacitor 308*c*, and applies the current to the laser diode 200 as a drive current. As a result of the operations described above, the amount of light emitted from the laser diode 200 is controlled to the maximum light amount P_max, which is the target light amount. At this time, the CPU 300 monitors a value obtained by digitalizing a voltage Vpd_max from the PD circuit board 214 using the analog-to-digital converter 302*a*, as a light amount value of 100%, and stores the same in the memory 314. Further, the CPU 300 transmits a MON_SEL signal to the switch 313 to thereby switch the switch 313 so as to make it possible to monitor the charge voltage Vch_max of the charge capacitor 308*c*, corresponding to a drive current for the maximum light amount P_max. Furthermore, the CPU 300 digitalizes the monitored charge voltage Vch_max using the analog-to-digital converter 302*b*, and stores the same in the memory 314 (step S1403).

Figure 6:
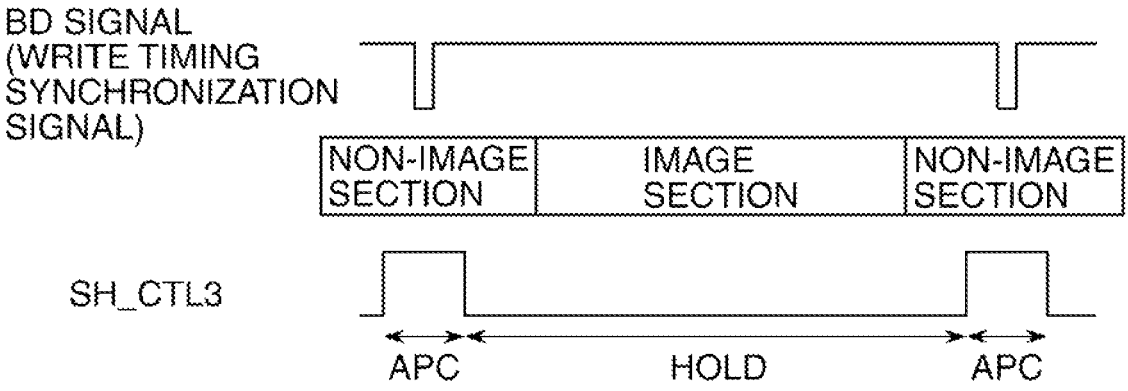
FIG. 6 is a timing diagram of APC in the light amount control process in FIGS. 5A and 5B.

The APC described above is performed in a non-image section, as shown in FIG. 6. This makes it possible to always control the amount of light emitted from the laser diode 200 to a constant light amount e.g. even if the I-L characteristics of the laser diode change due to a change in temperature or aging of the laser diode 200. Note that the term "I-L characteristics" refers to light emission characteristics indicative of a correspondence relationship between the value of drive current I and the amount of light emission L.

After execution of APC, the CPU 300 causes the threshold current calculation circuit 309 of the laser controller 210 to calculate a threshold current Ith of the laser diode 200.

The laser diode 200 emits light when a current equal to or larger than the threshold current Ith is supplied thereto. Therefore, to drive the laser diode 200 at a high speed, it is a general practice to always apply a bias current Ib in the vicinity of the threshold current Ith to the laser diode 200. To this end, it is necessary to calculate the threshold current Ith of the laser diode 200. Since the threshold current Ith changes e.g. due to a change in temperature or aging of the laser diode 200, it is desirable to calculate the threshold current Ith in real time using e.g. the non-image section.

Figure 17:
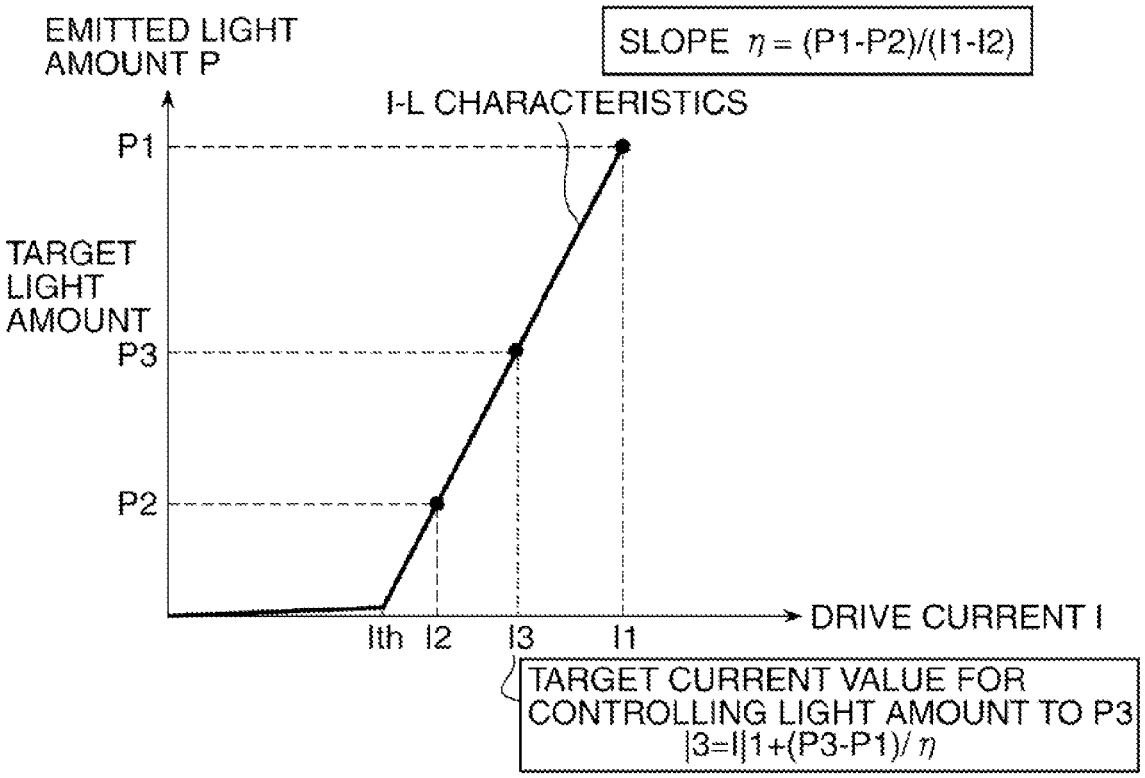
FIG. 17 is a view showing I-L characteristics of a general semiconductor laser diode.
Figure 18:
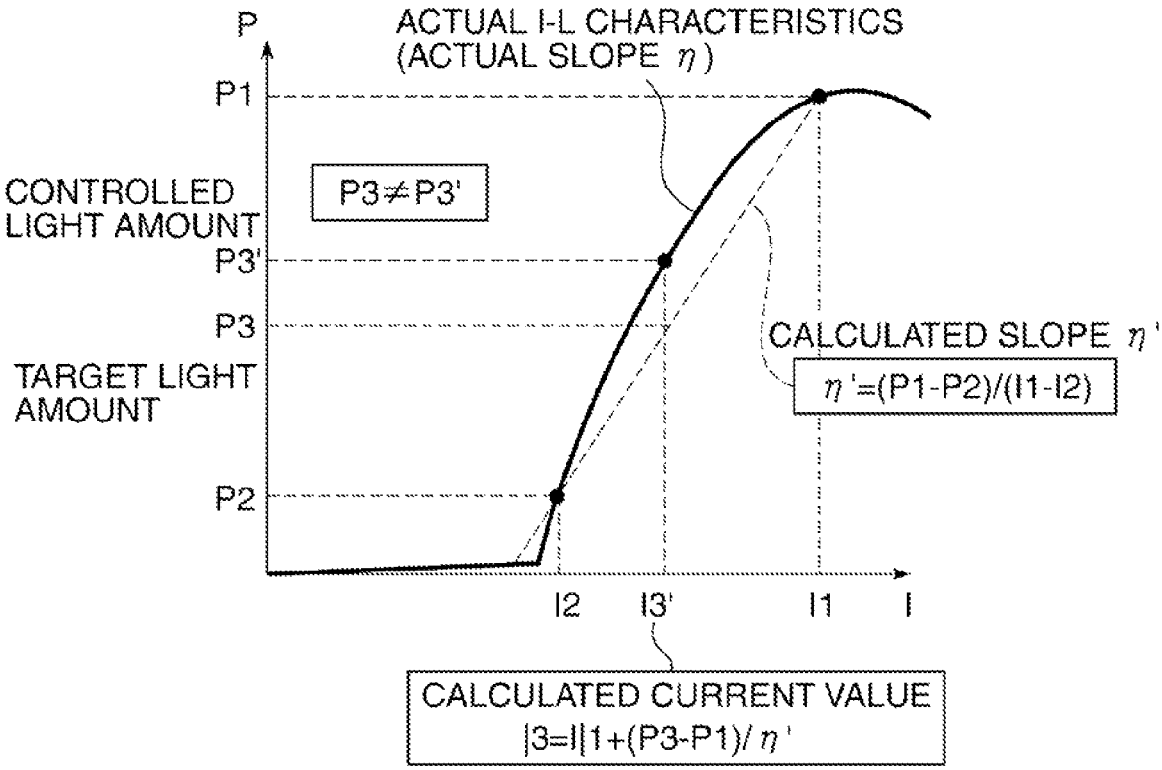
FIG. 18 is a view showing non-linear I-L characteristics of the semiconductor laser diode.
Figure 19:
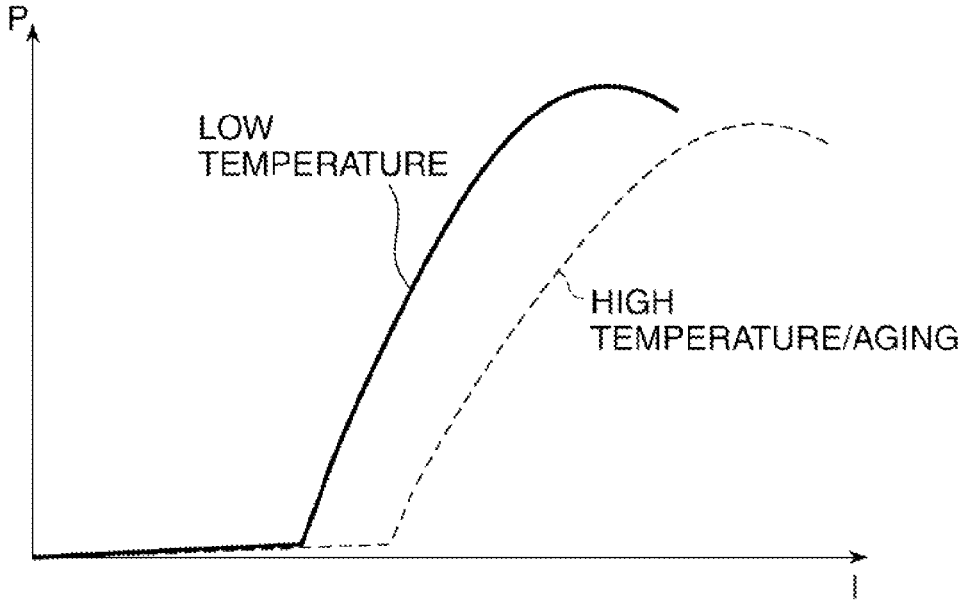
FIG. 19 is a view showing changes in the I-L characteristics of the semiconductor laser diode, which are caused by aging of the semiconductor laser diode.

As shown in FIG. 17, the I-L characteristics of a general laser diode are linear, and hence it is possible to calculate a slope of the I-L characteristics based on light amounts at two different points and drive currents associated therewith, and calculate a threshold current Ith based on the slope. Therefore, it is general to calculate the threshold current Ith based on a light amount controlled to be constant by APC and a light amount at a point other than a point indicating the light amount controlled to be constant.

Figure 7:
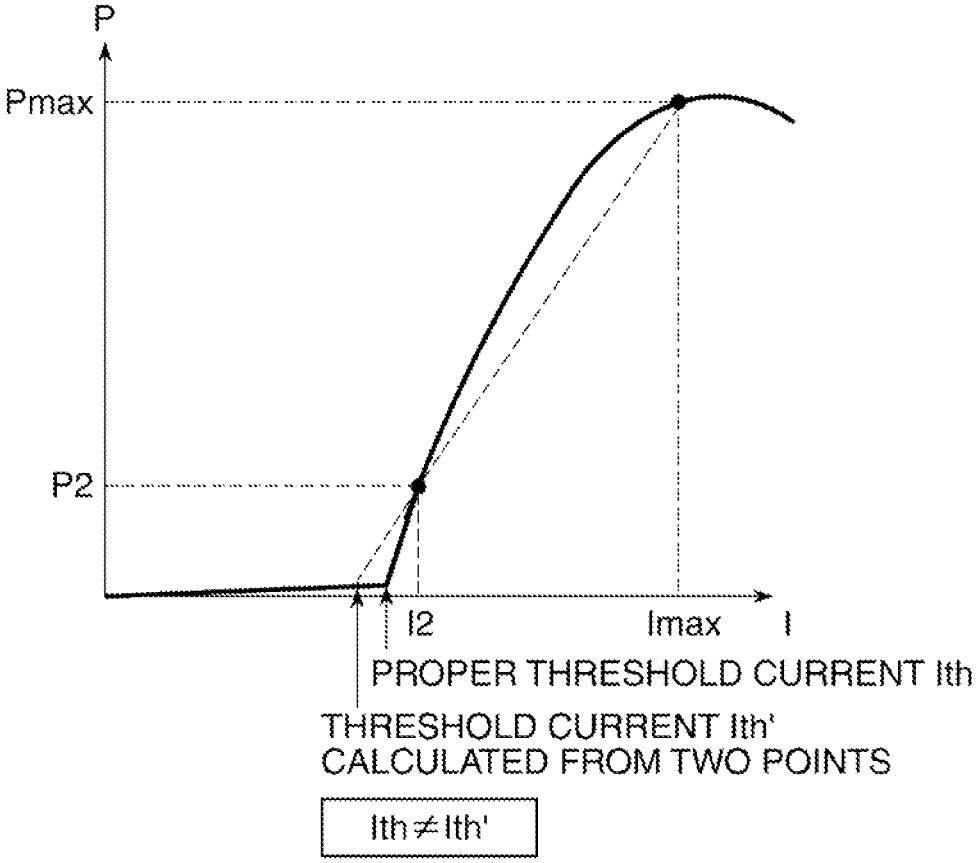
FIG. 7 is a view of a threshold current calculation error in calculation of a threshold current of a laser diode having non-linear I-L characteristics.

However, in the case of a laser diode as an object of the present invention, such as a surface emitting laser diode (VCSEL: vertical cavity surface emitting laser diode), which has non-linear I-L characteristics, the I-L characteristics become more non-linear as the amount of light emitted therefrom becomes larger. For this reason, when a threshold current of the laser diode is calculated by the above-described method, an error occurs between its proper threshold current Ith and the calculated threshold current Ith', as shown in FIG. 7.

Figure 8:
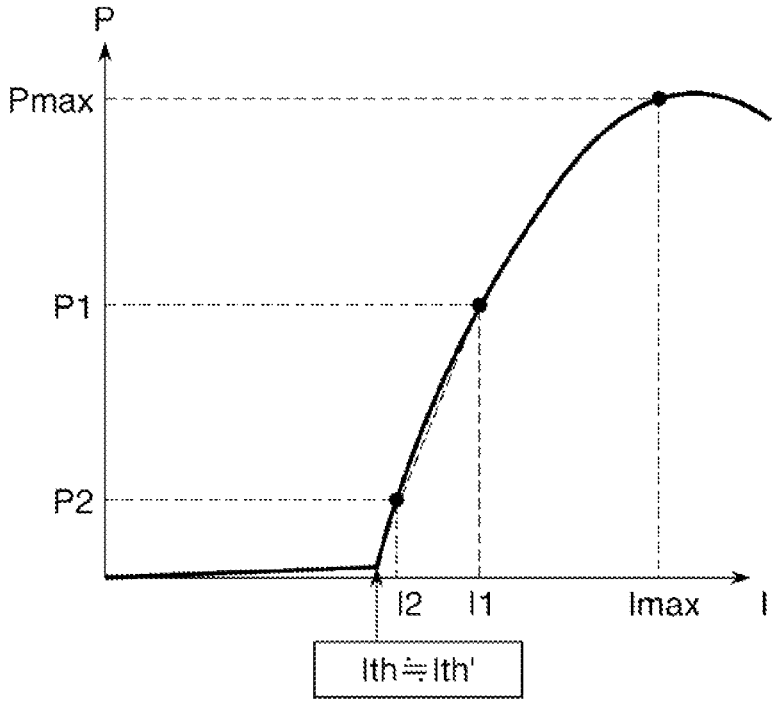
FIG. 8 is a view useful in explaining a method of calculating a threshold value for the laser diode having the non-linear I-L characteristics.

To solve this problem, in the present embodiment, as shown in FIG. 8, the slope of the I-L characteristics is calculated based on light amounts at two points, smaller than the maximum light amount P_max as the light amount controlled to be constant by APC, and drive currents associated with the respective light amounts, and a threshold current Ith is calculated based on the calculated slope.

Hereinafter, a description will be given of a threshold-current calculation operation in the present embodiment, in which a threshold current is calculated based on light amounts at two points other than the point indicating the light amount P_max controlled to be constant by APC, and drive currents associated with the respective light amounts.

First, when the voltage Vpd is input from the PD circuit board 214 to the laser controller 210 according to the amount of light emitted from the laser diode 200, the gain circuit 305*a* of the laser controller 210 amplifies the input voltage by a gain set in advance. In the present embodiment, the gain of the gain circuit 305*a* is set e.g. to 4.

Then, the comparator 306*a* compares a voltage Vpd_a amplified by a factor of four and a target voltage Vref set in the target voltage-setting section 304. As a result of the comparison, if the relationship therebetween is expressed by the following expression (3):

$$Vpd_a < V\mathrm{ref} \tag{3}$$

the comparator 306*a* determines that the amount of the light emitted from the laser diode 200 is lower than the target light amount. Then, the charging and discharging current generation circuit 307*a* charges the charge capacitor 308*a* to increase a charge voltage thereof.

On the other hand, when the relationship therebetween is expressed by the following expression (4):

$$Vpd_a > V\mathrm{ref} \tag{4}$$

the comparator 306*a* determines that the amount of the light emitted from the laser diode 200 is larger than the target light amount. Then, the charging and discharging current generation circuit 307*a* discharges electric charge accumulated in the charge capacitor 308*a* to reduce the charge voltage of the charge capacitor 308*a*. Note that the above-described charging and discharging operations are performed while an SH_CTL1 signal is being input from the CPU 300 to the charging and discharging current generation circuit 307*a*, and during the other times, the electric charge of the charge capacitor 308*a* is held.

Next, the V-I conversion circuit 312 generates a drive current according to a charge voltage Vch_a of the charge capacitor 308*a*, and supplies the drive current to the laser diode 200. In doing this, since the gain of the gain circuit 305*a* is set to 4, the amount of the light emitted from the laser diode 200 is controlled to ¼ of the maximum light amount P_max.

The gain circuit 305*b* as well amplifies the input voltage by a gain set in advance, similarly to the above-described operation. In the present embodiment, the gain of the gain circuit 305*b* is set e.g. to 2.

The comparator 306*b* compares a voltage Vpd_b amplified by a factor of 2 and the target voltage Vref set in the target voltage-setting section 304. As a result of the comparison, if the relationship therebetween is expressed by the following expression (5):

$$Vpd_b < V\mathrm{ref} \tag{5}$$

the comparator 306*b* determines that the amount of the light emitted from the laser diode 200 is lower than the target light amount. Then, the charging and discharging current generation circuit 307*b* charges the charge capacitor 308*b* to increase a charge voltage thereof.

On the other hand, when the relationship therebetween is expressed by the following expression (6):

$$Vpd_b > V\mathrm{ref} \tag{6}$$

the comparator 306*b* determines that the amount of the light emitted from the laser diode 200 is larger than the target light amount. Then, the charging and discharging current generation circuit 307*b* discharges electric charge accumulated in the charge capacitor 308*b* to reduce the charge voltage of the charge capacitor 308*b*. Note that the above-described charging and discharging operations are performed while an SH_CTL2 signal is being input from the CPU 300 to the charging and discharging current generation circuit 307*b*, and during the other times, the electric charge of the charge capacitor 308*b* is held.

Next, the V-I conversion circuit 312 generates a drive current according to a charge voltage Vch_b of the charge capacitor 308*b*, and applies the drive current to the laser diode 200. In doing this, since the gain of the gain circuit 305*b* is set to 2, the amount of the light emitted from the laser diode 200 is controlled to ½ of the maximum light amount P_max.

Next, the threshold current calculation circuit 309 calculates a threshold current based on the ¼ of the maximum light amount P_max and the charge voltage Vch_a of the charge capacitor 308*a* at that time, and the ½ of the maximum light amount P_max and the charge voltage Vch_b of the charge capacitor 308*b* at that time. The charge voltage Vch_b corresponds to a drive current. More specifically, the threshold current calculation circuit 309 calculates the slope of the I-L characteristics of the laser diode 200 based on the ¼ and ½ of the maximum light amount P_max, and the charge voltages Vch_a and Vch_b associated with the respective light amounts, and calculates a charge voltage Vth corresponding to the threshold current. Further, the threshold current calculation circuit 309 converts the voltage to the threshold current Ith (step S1404). The CPU 300 controls the laser controller 210 to always supply a current, which is obtained by multiplying the threshold current by the coefficient set in advance in the bias current coefficient-setting section 310, to the laser diode 200 as the bias current.

The above-described operations are performed in real time in a non-image section, whereby even when the threshold current has changed due to a change in temperature or aging of the laser diode 200, it is possible to always calculate an appropriate bias current to supply the bias current to the laser diode 200. At this time, the CPU 300 reads out a charge voltage V_th corresponding to the threshold current calculated by the threshold current calculation circuit 309, and stores the charge voltage in the memory 314.

Figure 9:
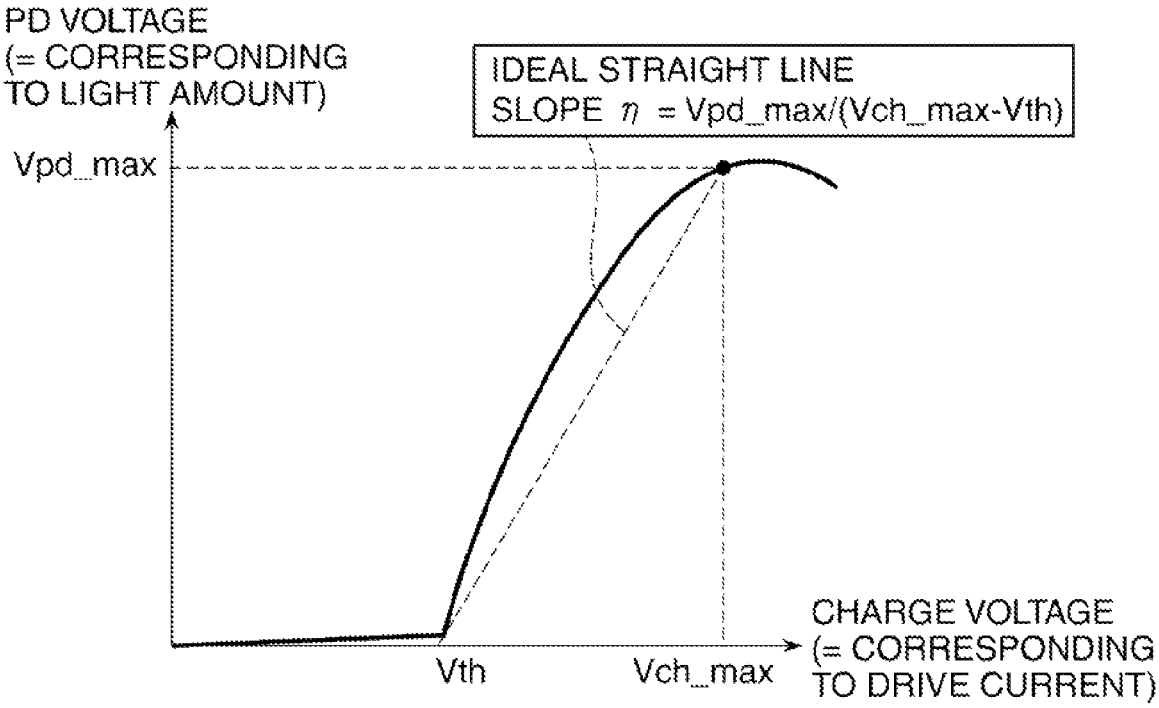
FIG. 9 is a conceptual diagram of light amount control for controlling an amount of light emitted from the laser diode having the non-linear I-L characteristics.

Further, at this time, by performing computation as shown in FIG. 9 using the above-described values Vpd_max, Vch_max, and Vth, the CPU 300 calculates a slope $\eta$ of an ideal straight line based on the assumption that the charge voltage of the laser diode 200 and the amount of light emitted from the laser diode 200 are directly proportional to each other, and stores the slope in the memory 314 (step S1405).

After execution of APC and the calculation of the threshold current as described above, the CPU 300 does not start printing immediately (step S1406) but determines whether or not it is required to correct the light amount of the laser diode 200. More specifically, in the image forming apparatus, the sensitivity of the photosensitive drums and the optical characteristics of the laser scanner affect the amount of light emitted from the laser diode 200, and hence the amount of emitted light is corrected based on the sensitivity of the photosensitive drums and the optical characteristics of the laser scanner. Correction of the amount of emitted light is performed by multiplying a maximum drive current corresponding to a maximum light amount P_max calculated by APC, by a predetermined coefficient.

Figure 10:
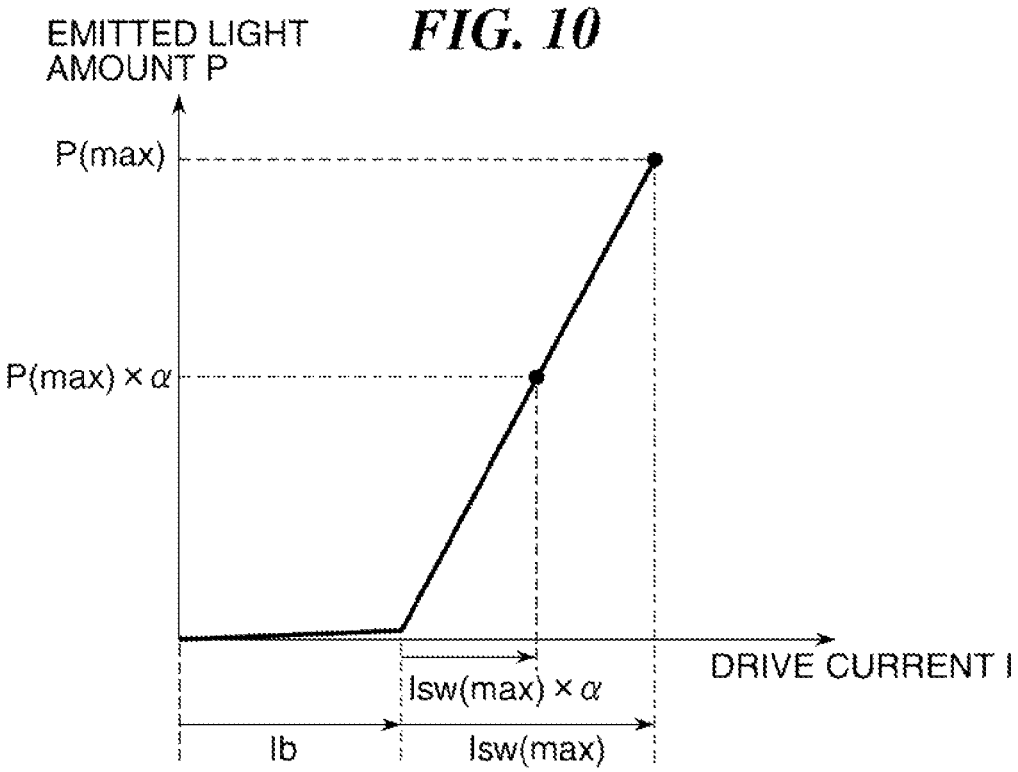
FIG. 10 is a conceptual diagram of light amount control for controlling an amount of light emitted from a laser diode having linear I-L characteristics.

FIG. 10 is a conceptual diagram of light amount control for controlling the amount of light to be emitted from a laser diode which is a general one, i.e. which has linear I-L characteristics. In FIG. 10, a bias current is denoted by Ib, and a current used for switchingly driving the laser diode is denoted by Isw. Since the general laser diode has liner I-L characteristics, it is possible to control the laser diode to emit a desired amount of light by multiplying Isw by a desired coefficient $\alpha$ ($Pmax \times \alpha$). For example, by multiplying Isw by 50%, the light amount as well is controlled to 50%.

Figure 11:
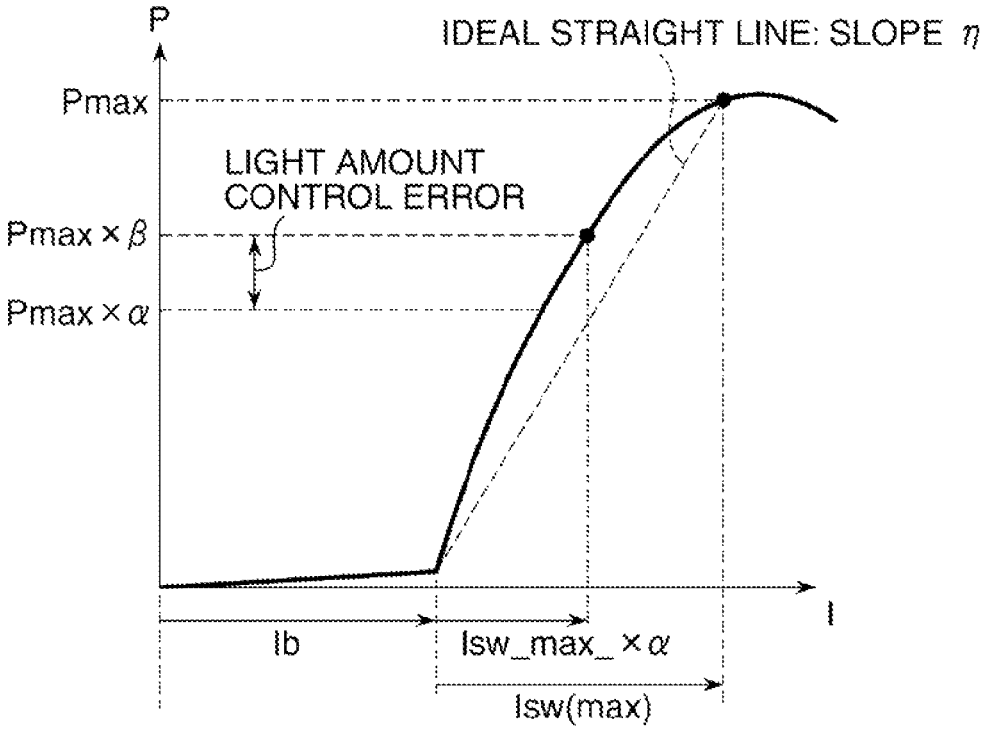
FIG. 11 is a view of a light amount control error in the light amount control of the laser diode having the non-linear I-L characteristics.

However, in the laser diode having non-linear I-L characteristics, which is the object of the present invention, even if the current for switching driving is multiplied by the coefficient $\alpha$, it is impossible to control the laser diode to emit a desired amount of light, as shown in FIG. 11.

To solve this problem, in the present embodiment, first, it is determined whether or not correction of the light amount based on the sensitivity of the photosensitive drums (hereinafter referred to as the "drum sensitivity-based correction") is to be performed for changing the drive current into one which makes it possible to obtain a desired light amount (step S1407).

If it is determined that the drum sensitivity-based correction is not to be performed (NO to the step S1407), the CPU 300 returns to the step S1402. On the other hand, if it is determined that the drum sensitivity-based correction is to be performed, i.e. if the drum sensitivity-based correction is on (YES to the step S1407), the CPU 300 performs the following processing.

Figure 12:
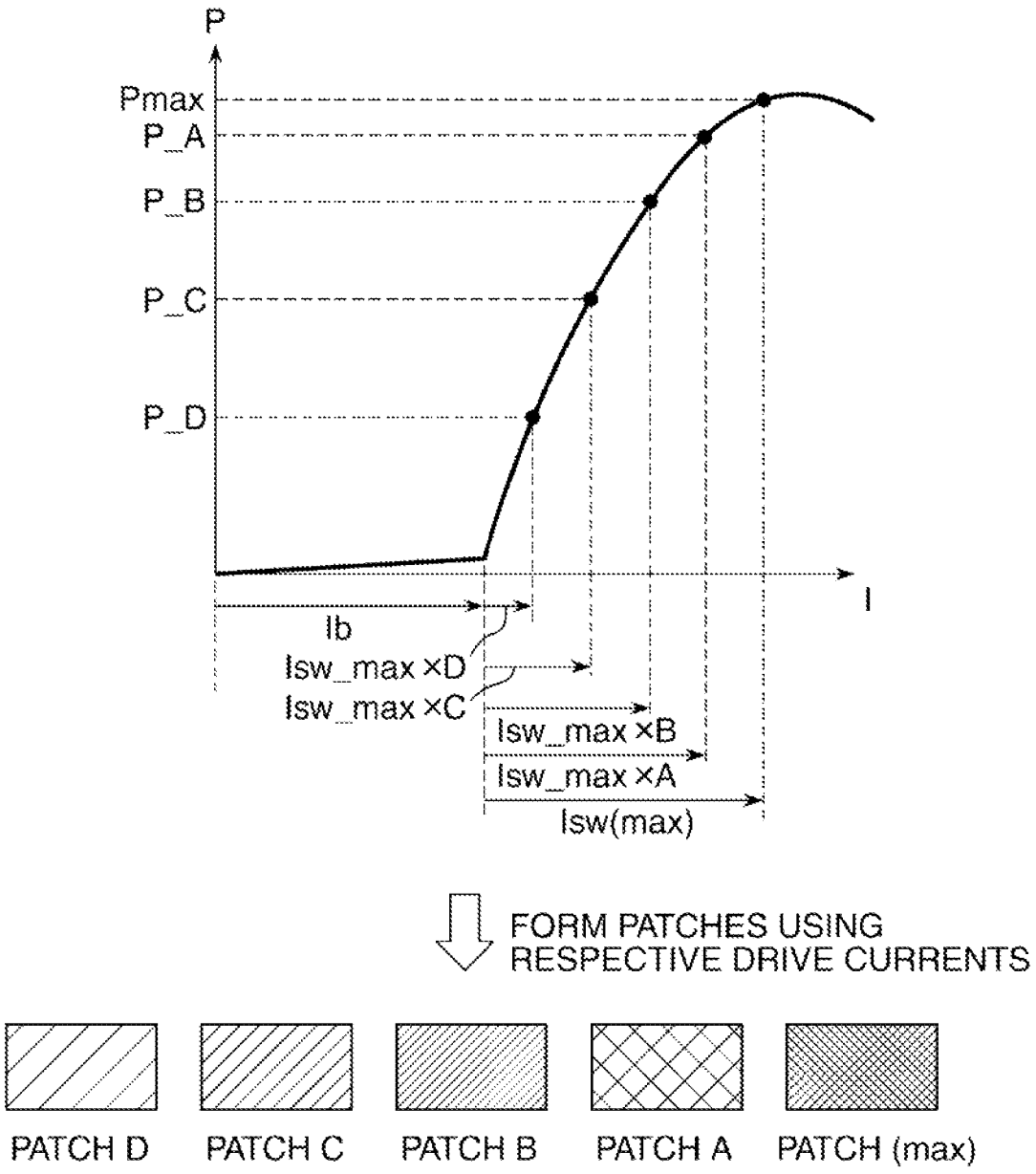
FIG. 12 is a conceptual diagram of drum sensitivity-based correction according to the present embodiment.

More specifically, as shown in FIG. 12, a plurality of density patches are formed on the photosensitive drums using light amounts obtained by a plurality of drive currents, and densities of the density patches are read by a density sensor, not shown. Then, a laser light amount providing a desired density (in FIG. 12, Patch B provides an optimum density) is detected, and a drive current correction coefficient (drum sensitivity-based correction coefficient) for calculating a proper light amount providing the optimum density in the present drum sensitivity is decided. After that, the drive current correction coefficient is set in the corrected current-setting section 315*a* of the laser controller 210 (step S1408). As a consequence, in an image area, the drive current applied to the laser diode 200 is multiplied by the drive current correction coefficient, and the current multiplied by the drive current correction coefficient is supplied to the laser diode 200, whereby a light amount associated with the desired density is output.

Figure 13:
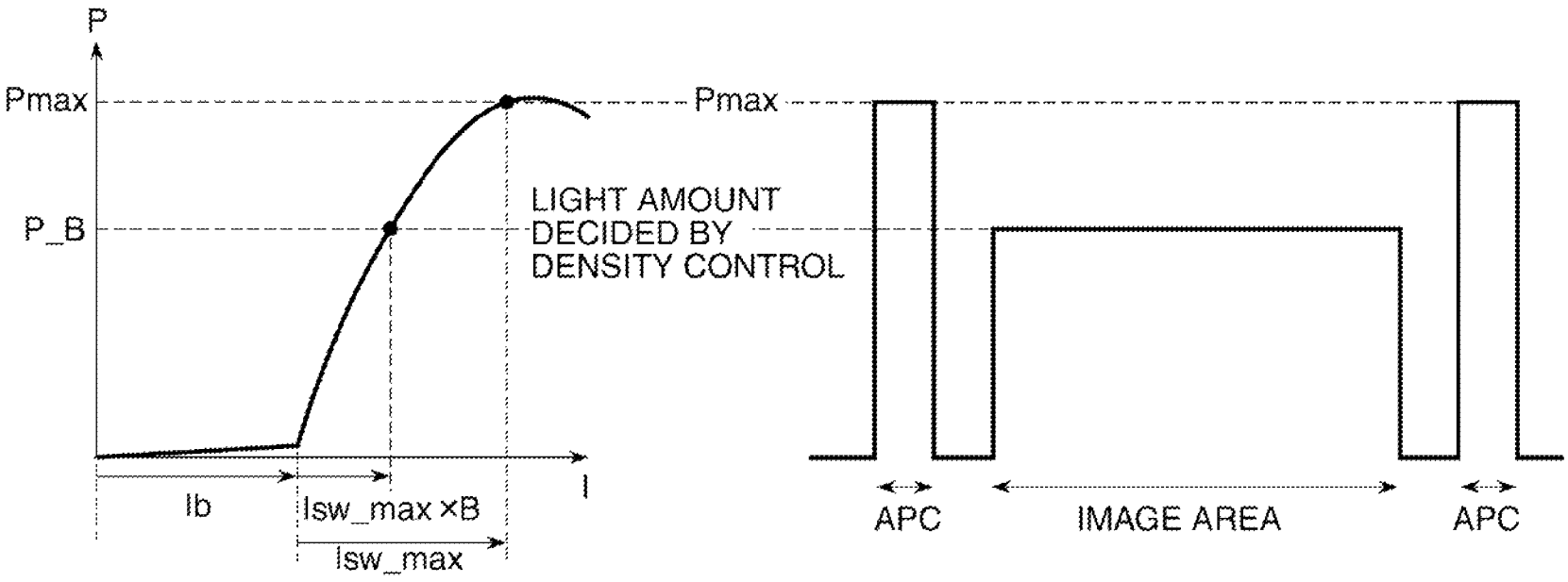
FIG. 13 is a view useful in explaining reflectance characteristics of a reflecting mirror and a method of correcting the reflectance characteristics, according to the present embodiment.

As illustrated in FIG. 13, the drum sensitivity-based correction described above is performed for light amount control uniformly irrespective of the position of the laser scanner in the main scanning direction. It is desirable to execute the drum sensitivity-based correction at predetermined time intervals when or after the power of the image forming apparatus 100 is turned on.

At this time, to know the light amount P_DR of light emitted from the laser diode 200 after the drum sensitivity-based correction, the CPU 300 causes the laser diode 200 to emit a laser beam with a corrected light amount, and digitalizes a voltage V_DR output from the PD circuit board 214 at this time, using the analog-to-digital converter 302*a*. Then, the CPU 300 stores a digital value of the voltage in the memory 314 (step S1409). As described above, the output voltage from the PD circuit board 214 has the linear characteristics with respect to the amount of emitted light. Therefore, the CPU 300 calculates a ratio P_RAT of the light amount P_DR after the drum sensitivity-based correction to the maximum light amount Pmax, by the following equation (7) (step S1410):

$$V_DR/Vpd_\mathrm{max}=P_RAT \tag{7}$$

Then, the CPU 300 sets the reciprocal {1/(P_RAT)} of the ratio P_RAT of P_DR to Pmax calculated by the above-mentioned equation (7) in the gain circuit 305*b* (step S1411). After that, the CPU 300 transmits the SH_CTL2 signal to the charging and discharging current generation circuit 307*b*, and performs APC, to thereby control the light amount to the Pmax×P_RAT. Here, to detect the drive current at this time, the CPU 300 delivers the MON_SEL signal to the switch 313 to switch the switch 313 so as to make it possible to monitor a charge voltage Vch_DR of the charge capacitor 308*b*, corresponding to the drive current. Then, the CPU 300 converts the charge voltage to a digital value by the analog-to-digital converter 302*b*, monitors the digital value, and stores the monitored digital value in the memory 314 (step S1412).

Next, the CPU 300 performs light amount control based on the optical characteristics of the laser scanner (hereinafter referred to as "optical characteristic-based correction").

First, optical characteristic-based correction of the general laser diode having liner I-L characteristics will be described with reference to FIG. 14.

Figure 14:
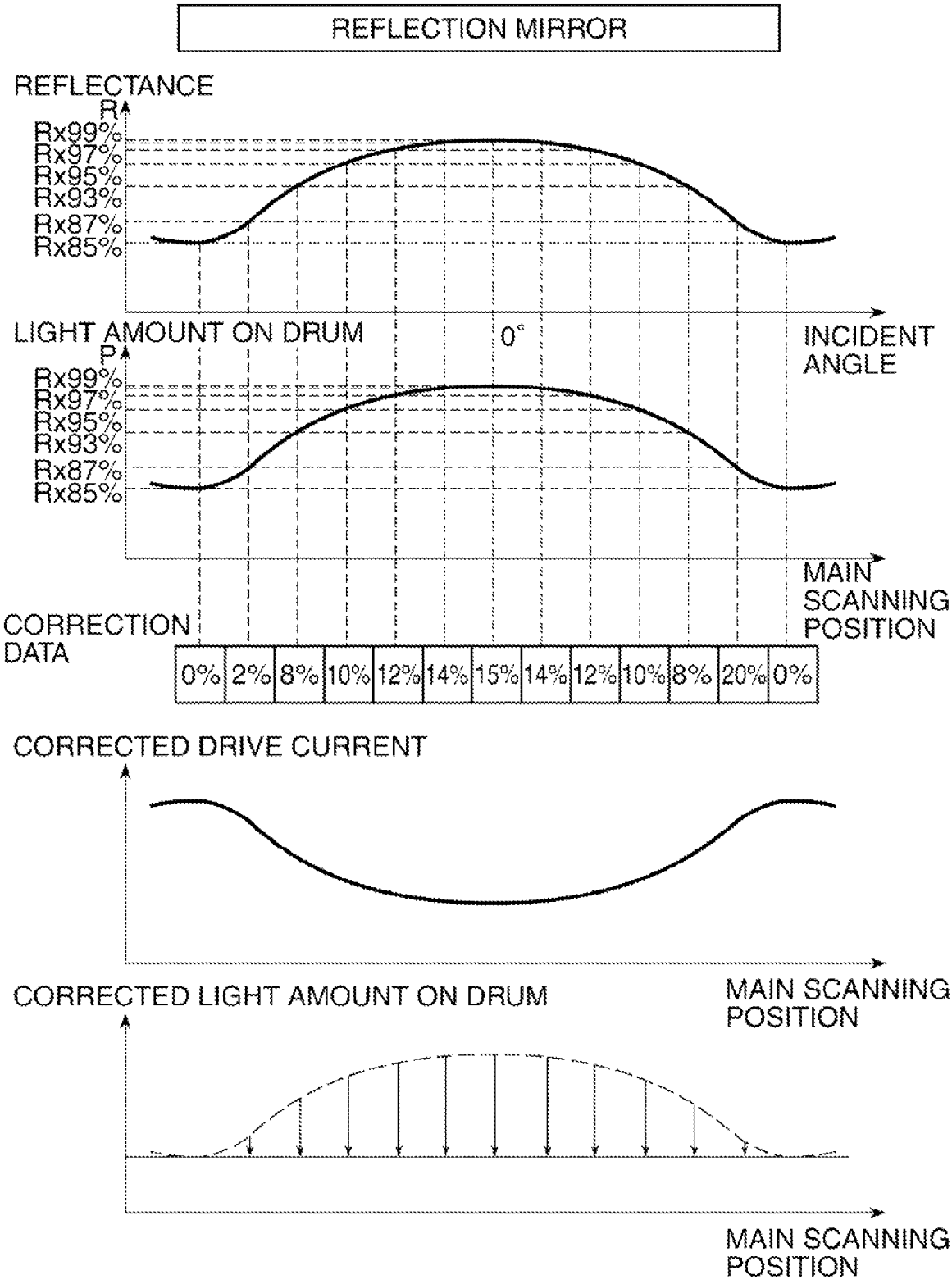
FIG. 14 is a conceptual diagram of the method of correcting the reflectance characteristics of the reflecting mirror according to the present embodiment.

The reflectance of the aforementioned reflection mirror, not shown, of the laser scanner 101 varies with an incident angle, as shown in FIG. 14. Further, the transmittance of the lens for a laser beam also varies with a main scanning position. For this reason, even when the laser diode 200 emits a constant amount of laser beam, the amount of laser beam irradiating the photosensitive drum varies with the main scanning position. To cope with this problem, the characteristics of the reflectance of the aforementioned reflection mirror, not shown, and the transmittance of the lens are measured in advance during assembly of the laser scanner, and coefficients determined based on data of the reflectance data and data of the transmittance are stored in the memory 314 as drive current correction coefficients for correcting the drive current (hereinafter referred to as the "optical correction coefficients"). That is, predetermined positions of the laser scanner in the main scanning direction, and optical correction coefficients associated with the respective predetermined positions are stored in the memory 314. Specifically, assuming that the maximum reflectance (denoted by R in FIG. 14) for the main scanning position is 100%, and a reflectance associated with a predetermined position spaced by a predetermined distance from the position of the maximum reflectance 100% is 85%, position data thereof and the difference of 15% from 100% are stored in the memory 314 in a state associated with each other.

Therefore, data items stored in the memory 313 as described above are each read out in synchronism with a signal delivered from the synchronization sensor 209, and as to the predetermined position mentioned above, a setting of "100%-15%=85%" is set in the corrected current-setting section 315*b*, whereby a drive current for driving the laser diode 200 is multiplied by the setting (coefficient). The drive current is thus corrected and the amount of light emitted from the laser diode 200 is controlled to a desired light amount at each position in the main scanning direction. Therefore, the light amounts on the surface of the photosensitive drum become uniform irrespective of positions in the main scanning direction. Note that the above light amount control is performed on the light amount P_DR having undergone the drum sensitivity-based correction.

By the way, in the case of the laser diode having linear I-L characteristics, the amount of light emitted therefrom can be controlled to a desired amount by directly multiplying a drive current by reflectance data (optical correction coefficients), as described above.

However, in the case of the laser diode having non-linear I-L characteristics, which is the object of the present invention, even if the drive current for driving the same is directly multiplied by a coefficient, it is impossible to control the laser diode to a desired light amount, as illustrated in FIG. 11.

Figure 15:
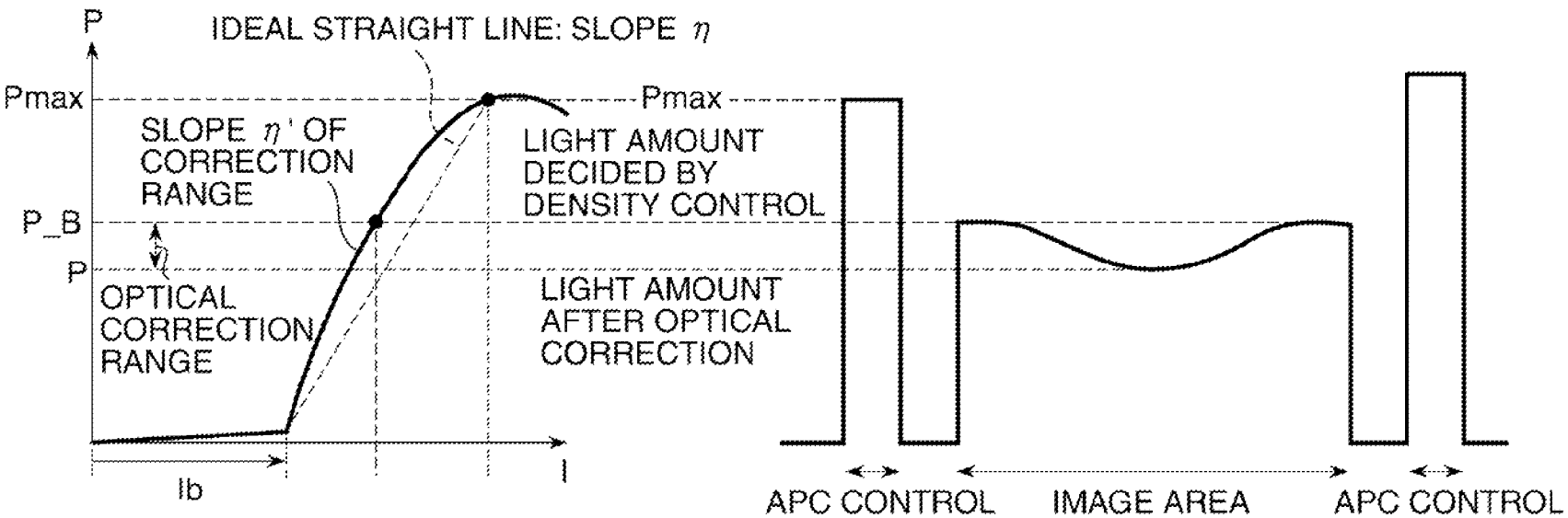
FIG. 15 is a view showing a relationship between a PD voltage (light amount) and a charge voltage (drive current) in the laser diode having the non-linear I-L characteristics, in which the relationship is shown in comparison with a slope of an ideal straight line.

To solve this problem, in the present embodiment, as shown in FIG. 15, the CPU 300 calculates a slope η' of I-L characteristics of the laser diode within a range for light amount correction of the laser diode, and multiplies an optical correction coefficient D in the memory 314 by a ratio η/η' of the slope η of the aforementioned ideal straight line and the slope η'. Thus, the CPU 300 corrects the optical correction coefficient D, and sets the same in the corrected current-setting section 315*b*.

Hereinafter, a description will be given of the optical characteristic-based correction in the present embodiment.

First, the CPU 300 searches the optical correction coefficients D of the laser scanner, stored in the memory 314 in advance, for a maximum correction value D_MAX (step S1413). Then, the CPU 300 calculates a value P_CAL based on the maximum correction value D_MAX and the ratio P_RAT of the light amount P_DR after the drum sensitivity-based correction to the above-mentioned maximum light amount Pmax, by the following equation (8) (step S1414).

$$P_RAT \times (1 - D_MAX) = P_CAL \quad (8)$$

P_CAL gives a smallest light amount after the optical characteristic-based correction performed according to the optical characteristics of the laser scanner.

Then, the CPU 300 sets the reciprocal (1/P_CAL) of P_CAL in the gain circuit 305*a* (step S1415), transmits the SH_CTL1 signal to the charging and discharging current generation circuit 307*a*, and performs APC, to thereby control the amount of emitted light to P_CAL. Further, the CPU 300 stores a PD voltage V_CAL at this time in the memory 314 (step S1416), and delivers the MON_SEL signal to the switch 313. The CPU 300 switches the switch 313 so as to make it possible to monitor a charge voltage Vch_CAL of the charge capacitor 308*a*, corresponding to a drive current at this time. Then, the CPU 300 converts the charge voltage to a digital value by the analog-to-digital converter 302*b*, monitors the digital value, and stores the monitored digital value in the memory 314 (step S1417).

Figure 16:
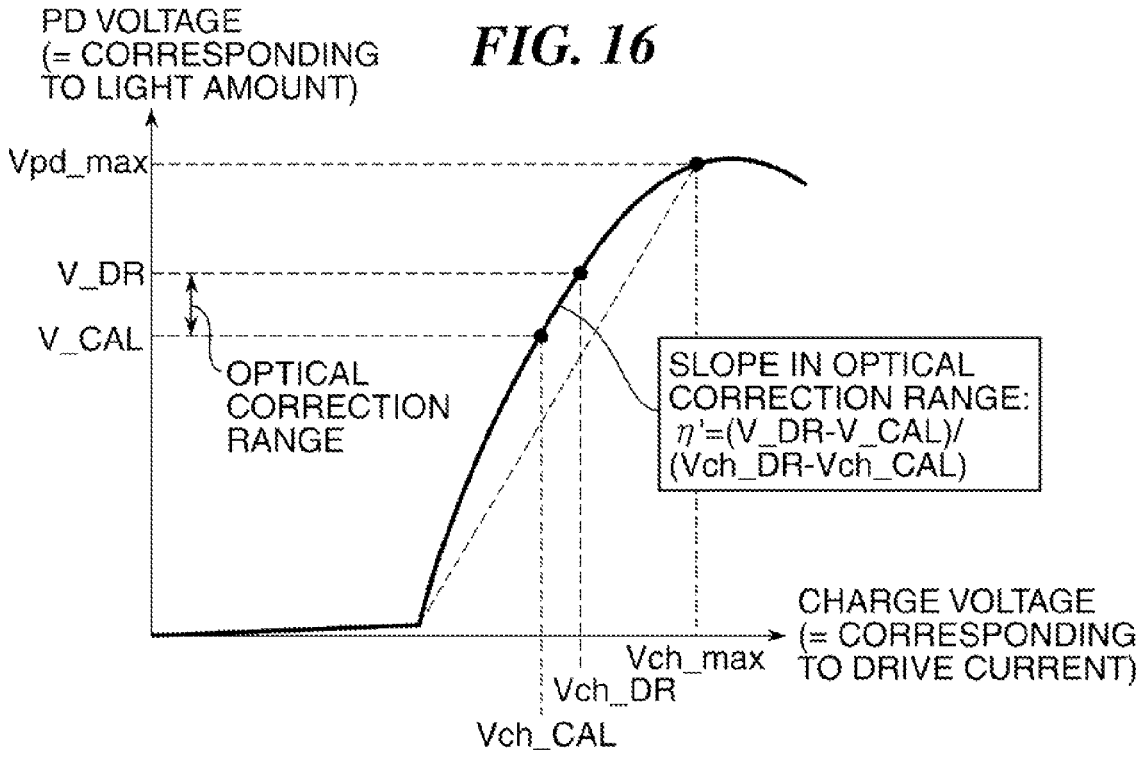
FIG. 16 is a view showing the relationship between the PD voltage (light amount) and the charge voltage (drive current) in the laser diode having the non-linear I-L characteristics, particularly a slope in an optical correction range.

At this time, the CPU 300 performs calculation shown in FIG. 16 based on the above-described V_DR, Vch_DR, V_CAL, and Vch_CAL, and calculates a range of the light amount correction and the slope T' of the I-L characteristics of the laser diode within the range of the light amount correction (step S1418). Then, the CPU 300 calculates a corrected optical correction coefficient D' from the optical correction coefficient D stored in the memory 314, using the slope η of the ideal straight line and the slope η' of the I-L characteristics of the laser diode within the light amount correction range, by the following equation (9) (step S1419):

$$D' = (1 - D) \times \eta / \eta' \quad (9)$$

After the above correction, the CPU 300 sets the corrected optical correction coefficient D' in the corrected current-setting section 315*b* to thereby update the optical correction coefficient D (step S1420), and controls the laser diode 200 to a desired light amount. This makes it possible to perform high-accuracy light amount control even when a laser diode having non-linear I-L characteristics is used.

It is desirable to execute calculation of the optical correction coefficient D' and updating operation using the optical correction coefficient D' whenever drum sensitivity-based correction is performed. This makes it possible to update the optical correction coefficient D according to a currently used light amount correction range and the I-L characteristics of the laser diode 200. After that, when the start of printing is selected (YES to the step S1406), light amount control is performed by correcting the drive current using the optical correction coefficient D' (step S1421). After execution of the light amount control using the optical correction coefficient D', printing is started, and the present process is terminated (step S1422).

According to the light amount control process shown in FIGS. 5A and 5B, the amount of light emitted from the laser scanner is calculated based on the I-L characteristics, and is subjected to the drum sensitivity-based correction according to the sensitivity of the photosensitive drums, and the optical characteristic-based correction according to the optical characteristics of the laser scanner. This makes it possible to perform high-accuracy light amount control without complicated control even when the laser scanner uses a laser diode having non-linear I-L characteristics.

In the present embodiment, it is desirable to perform the optical characteristic-based correction of the amount of light emitted from the laser scanner after the light amount has been subjected to the drum sensitivity-based correction. Further, it is desirable to perform the drum sensitivity-based correction and the optical characteristic-based correction in real time, e.g. when the laser scanner is started up or whenever a predetermined operating time period elapses after the start thereof. This makes it possible to perform light amount control in a manner following up changes in temperature and aging of the photosensitive drums.

Note that although in the present embodiment, reflectance data of the reflection mirror is stored in the memory 314, and the slope η' is calculated based on the reflectance data, the same algorithm as applied to the reflectance data can be applied to data e.g. of sensitivity unevenness of the photosensitive drums.

Aspects of the present invention can also be realized by a computer of a system or apparatus (or devices such as a CPU or MPU) that reads out and executes a program recorded on a memory device to perform the functions of the above-described embodiment, and by a method, the steps of which are performed by a computer of a system or apparatus by, for example, reading out and executing a program recorded on a memory device to perform the functions of the above-described embodiment. For this purpose, the program is provided to the computer for example via a network or from a recording medium of various types serving as the memory device (e.g., computer-readable medium).

While the present invention has been described with reference to exemplary embodiment, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2012-101250 filed Apr. 26, 2012, which is hereby incorporated by reference herein in its entirety.

What is claimed is:

1. A light beam scanning device comprising:

a laser diode configured to emit an amount of light based on a value of drive current supplied thereto;

a light amount-setting unit configured to set the amount of light to be emitted from the laser diode;

a light amount detection unit configured to detect the amount of light emitted from the laser diode;

a light amount control unit configured to control the amount of light to be emitted from the laser diode by adjusting the value of drive current supplied to the laser diode based on a detection output from the light amount detection unit; and a data correction unit configured to correct correction data for correcting the value of the drive current, wherein the data correction unit decides a light amount correction range in which the amount of light to be emitted amount is corrected based on a value of the correction data, calculates a slope of light emission characteristics representative of a correspondence relationship between the value of drive current and the amount of light to be emitted of the laser diode within the light amount correction range based on light amounts at two points within the light amount correction range and values of drive current associated with the light amounts at the two points, and corrects the correction data using the calculated slope, and wherein correction of the correction data is performed by multiplying the correction data by a ratio (η/η') between a slope η of the light emission characteristics based on an assumption that the light emission characteristics of the laser diode are linear and a calculated slope η' of the light emission characteristics of the laser diode.

2. The light beam scanning device according to claim 1, wherein the correction data is an optical correction coefficient for correcting optical characteristics of the laser diode.

3. The light beam scanning device according to claim 1, wherein the light amount control unit includes a current correction unit configured to correct the value of the drive current supplied to the laser diode based on sensitivity of a photosensitive member on which the laser diode scans laser light, and wherein the value of the drive current corrected by the current correction unit is corrected by the correction data corrected by the data correction unit, and the drive current having the corrected value is supplied to the laser diode.

4. The light beam scanning device according to claim 1, wherein the data correction unit performs correction for correcting the correction data when the light beam scanning device is started up or whenever a predetermined time period elapses after the start of the light beam scanning device.

5. The light beam scanning device according to claim 1, further comprising a threshold current calculation unit configured to calculate a threshold current of the laser diode, based on a plurality of light amounts and values of the drive current associated with the light amounts, respectively.

6. The light beam scanning device according to claim 1, wherein the laser diode is a surface emitting laser diode.

7. An image forming apparatus comprising:

a photosensitive member; and an image forming unit that forms an image on the photosensitive member, the image forming unit including a light beam scanning device, wherein the light beam scanning device comprises:

a laser diode configured to emit an amount of light based on a value of drive current supplied thereto;

a light amount-setting unit configured to set the amount of light to be emitted from the laser diode;

a light amount detection unit configured to detect the amount of light emitted from the laser diode;

a light amount control unit configured to control the amount of light to be emitted from the laser diode by adjusting the value of drive current supplied to the laser diode based on a detection output from the light amount detection unit; and a data correction unit configured to correct correction data for correcting the value of the drive current, wherein the data correction unit decides a light amount correction range in which the amount of light to be emitted amount is corrected based on a value of the correction data, calculates a slope of light emission characteristics representative of a correspondence relationship between the value of drive current and the amount of light to be emitted of the laser diode within the light amount correction range based on light amounts at two points within the light amount correction range and values of drive current associated with the light amounts at the two points, and corrects the correction data using the calculated slope, and wherein correction of the correction data is performed by multiplying the correction data by a ratio (η/η') between a slope η of the light emission characteristics based on an assumption that the light emission characteristics of the laser diode are linear and a calculated slope η' of the light emission characteristics of the laser diode.

8. A method of controlling a light beam scanning device, comprising:

setting an amount of light to be emitted from a laser diode having non-linear light emission characteristics;

detecting an amount of light emitted from the laser diode;

controlling the amount of light to be emitted from the laser diode by adjusting a value of drive current to be supplied to the laser diode based on the detected amount of light; and correcting correction data for correcting the value of the drive current, wherein the correcting of the correction data includes deciding a light amount correction range in which the amount of light to be emitted amount is corrected based on a value of the correction data, calculating a slope of light emission characteristics representative of a correspondence relationship between the value of drive current and the amount of light to be emitted of the laser diode within the light amount correction range, based on light amounts at two points within the light amount correction range and values of drive current associated with the light amounts at the two points, and correcting the correction data using the calculated slope, and wherein correction of the correction data is performed by multiplying the correction data by a ratio ($\eta/\eta'$) between a slope $\eta$ of the light emission characteristics based on an assumption that the light emission characteristics of the laser diode are linear and a calculated slope $\eta'$ of the light emission characteristics of the laser diode.

9. A non-transitory computer-readable storage medium storing a computer-executable control program for executing a method of controlling a light beam scanning device, wherein the method comprises:

setting an amount of light to be emitted from a laser diode having non-linear light emission characteristics;

detecting an amount of light emitted from the laser diode;

controlling the amount of light to be emitted from the laser diode by adjusting a value of drive current to be supplied to the laser diode based on the detected amount of light; and correcting correction data for correcting the value of the drive current, wherein the correcting of the correction data includes deciding a light amount correction range in which the amount of light to be emitted amount is corrected based on a value of the correction data, calculating a slope of light emission characteristics representative of a correspondence relationship between the value of drive current and the amount of light to be emitted of the laser diode within the light amount correction range, based on light amounts at two points within the light amount correction range and values of drive current associated with the light amounts at the two points, and correcting the correction data using the calculated slope, and wherein correction of the correction data is performed by multiplying the correction data by a ratio ($\eta/\eta'$) between a slope $\eta$ of the light emission characteristics based on an assumption that the light emission characteristics of the laser diode are linear and a calculated slope $\eta'$ of the light emission characteristics of the laser diode.

* * * * *